US009774146B2

(12) United States Patent
Cheng et al.

(10) Patent No.: US 9,774,146 B2
(45) Date of Patent: Sep. 26, 2017

(54) CABLE CONNECTOR ASSEMBLY WITH IMPROVED PRINTED CIRCUIT BOARD MODULE

(71) Applicant: FOXCONN INTERCONNECT TECHNOLOGY LIMITED, Grand Cayman (KY)

(72) Inventors: Wei-Wei Cheng, Kunshan (CN); Xiao Fan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/884,782

(22) Filed: Oct. 16, 2015

(65) Prior Publication Data

US 2016/0111829 A1 Apr. 21, 2016

(30) Foreign Application Priority Data

Oct. 16, 2014 (CN) ..... 2014 2 0596991 U

(51) Int. Cl.

| | |
|---|---|
| ***H01R 13/66*** | (2006.01) |
| ***H01R 13/436*** | (2006.01) |
| *H01R 4/70* | (2006.01) |
| *H01R 12/53* | (2011.01) |
| *H01R 24/28* | (2011.01) |
| *H01R 24/60* | (2011.01) |

(52) U.S. Cl.

CPC ..... *H01R 13/665* (2013.01); *H01R 13/4361* (2013.01); *H01R 4/70* (2013.01); *H01R 12/53* (2013.01); *H01R 24/28* (2013.01); *H01R 24/60* (2013.01)

(58) Field of Classification Search

CPC .. H01R 13/665; H01R 13/4361; H01R 12/60; H01R 24/28

USPC ..... 439/620.22, 620.24, 620.25, 620.06, 439/620.15, 620.21, 352, 76.1

See application file for complete search history.

(56) References Cited

U.S. PATENT DOCUMENTS

| | | | | |
|---|---|---|---|---|
| 3,399,374 A * | 8/1968 | Pauza | ..... | H01R 13/514 174/138 F |
| 4,900,261 A * | 2/1990 | Gentry | ..... | H01R 13/6273 439/353 |
| 5,660,567 A * | 8/1997 | Nierlich | ..... | A61B 5/14551 439/620.21 |
| 5,890,931 A * | 4/1999 | Ittah | ..... | H01R 13/6456 439/677 |
| 8,062,052 B2 * | 11/2011 | Wu | ..... | H01R 13/516 439/352 |
| 8,147,255 B2 * | 4/2012 | Wu | ..... | H01R 13/506 439/358 |

(Continued)

*Primary Examiner* — Harshad Patel

(74) *Attorney, Agent, or Firm* — Wei Te Chung; Ming Chieh Chang

(57) ABSTRACT

A cable connector assembly (100) comprises an insulative housing having a receiving space (18) extending along a front-to-back direction, and a printed circuit board module (2) received in the receiving space of the insulative housing. The printed circuit board module defines a protruded ridge (24) offset to one side thereof, the protruded ridge extending along a vertical direction, and a groove (185) is defined in the receiving space for accommodating the protruded ridge.

1 Claim, 7 Drawing Sheets

(56) References Cited

U.S. PATENT DOCUMENTS

| | | | | |
|---|---|---|---|---|
| 8,439,706 | B2 * | 5/2013 | Sytsma | H01R 13/65802 439/607.19 |
| 8,523,598 | B2 * | 9/2013 | Wu | H01R 13/6275 439/352 |
| 8,770,990 | B2 * | 7/2014 | Sytsma | H01R 9/034 439/76.1 |
| 8,834,185 | B2 | 9/2014 | Wu | |
| 9,385,488 | B2 * | 7/2016 | Qi | H01R 12/721 |
| 2013/0109242 | A1 * | 5/2013 | Li | H01R 12/53 439/660 |

* cited by examiner

CABLE CONNECTOR ASSEMBLY WITH IMPROVED PRINTED CIRCUIT BOARD MODULE

BACKGROUND OF THE INVENTION

1. Field of the Invention

The present invention generally relates to a cable connector assembly, and more particularly to a cable connector assembly having an improved printed circuit board module.

2. Description of Related Art

U.S. Pat. No. 8,834,185 issued to Wu on Sep. 16, 2014 discloses a cable connector assembly comprising an insulative housing defining a receiving space therein communicated with an exterior along a longitudinal direction. Two printed circuit board (PCB) modules are arranged in substantially a stacked manner and received into the receiving space. Each PCB module comprises a printed circuit board, four cables electrically connected with the printed circuit board, and an insulator over-molding around a front end of the cables and a rear end of the printed circuit board for protecting a connection between the printed circuit board and the cables. Each PCB module further has a plurality of ridges on both top surface and bottom surface thereof, the ridges are symmetrically arranged along a longitudinal axis. The two printed circuit boards have same configuration but each with different conductive traces on its top and bottom surfaces; an operator may fail to identify correct plugging direction.

Hence, it is desirable to have an improved structure to overcome the above-mentioned disadvantages of the prior art.

BRIEF SUMMARY OF THE INVENTION

Accordingly, the object of the present invention is to provide a cable connector assembly with an improved printed circuit board module.

In order to achieve the above-mentioned object, a cable connector assembly in accordance with the present invention comprises an insulative housing having a receiving space extending along a front-to-back direction, and a printed circuit board module received in the receiving space of the insulative housing. The printed circuit board module defines a protruded ridge offset to one side thereof, the protruded ridge extends along a vertical direction, and a groove is defined in the receiving space for accommodating the protruded ridge.

Other objects, advantages and novel features of the invention will become more apparent from the following detailed description of the present embodiment when taken in conjunction with the accompanying drawings.

DETAILED DESCRIPTION OF THE INVENTION

Figure 1:
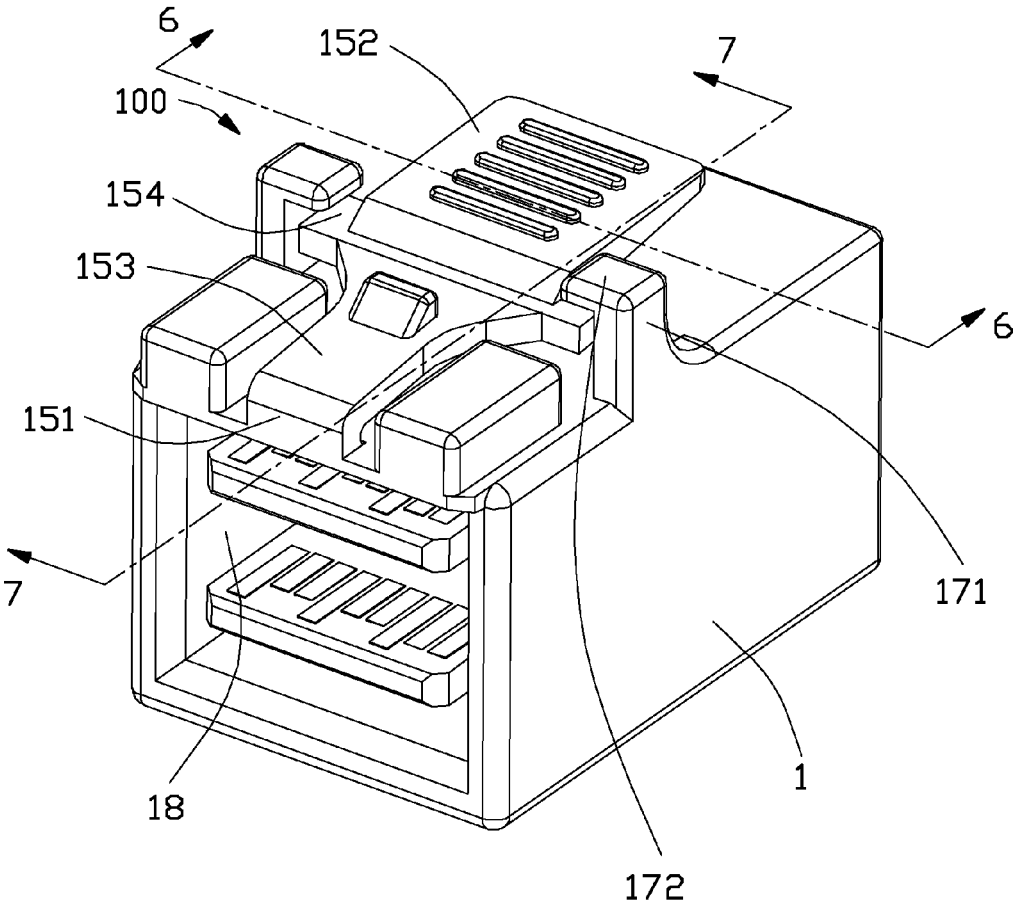
FIG. 1 is an assembled, perspective view of a cable connector assembly in accordance with the present invention.
Figure 2:
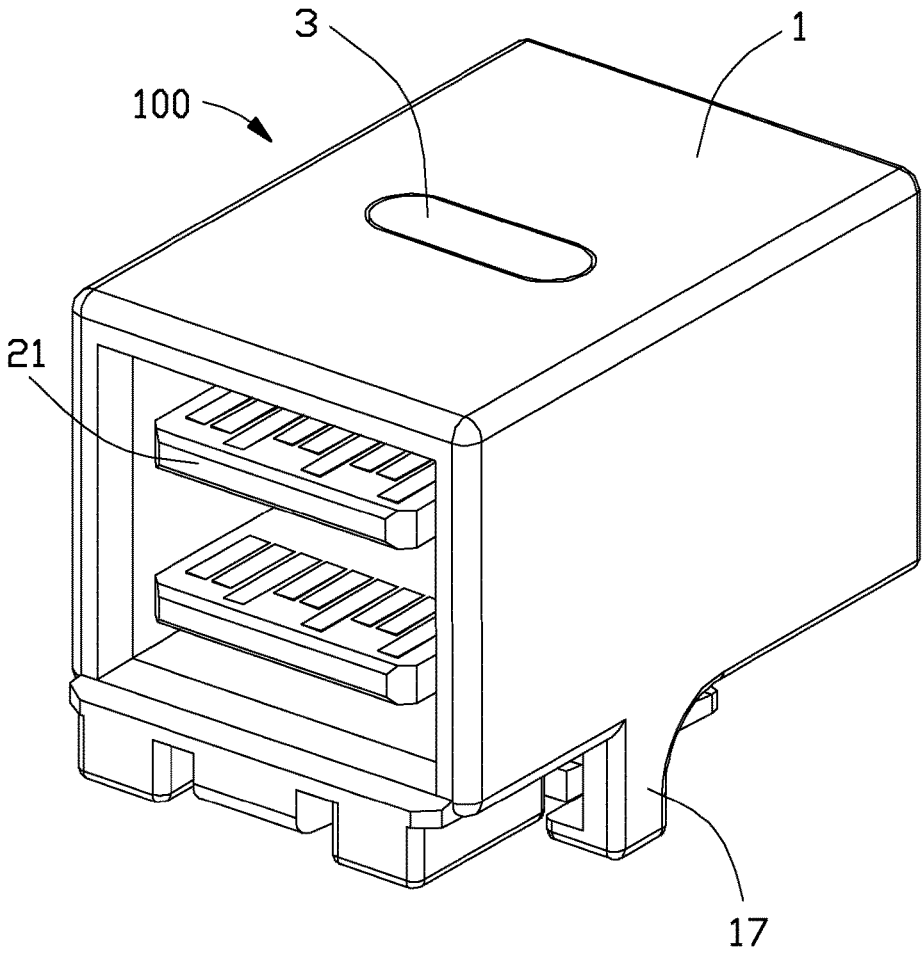
FIG. 2 is a view similar to FIG. 1, but viewed from a different angle.
Figure 3:
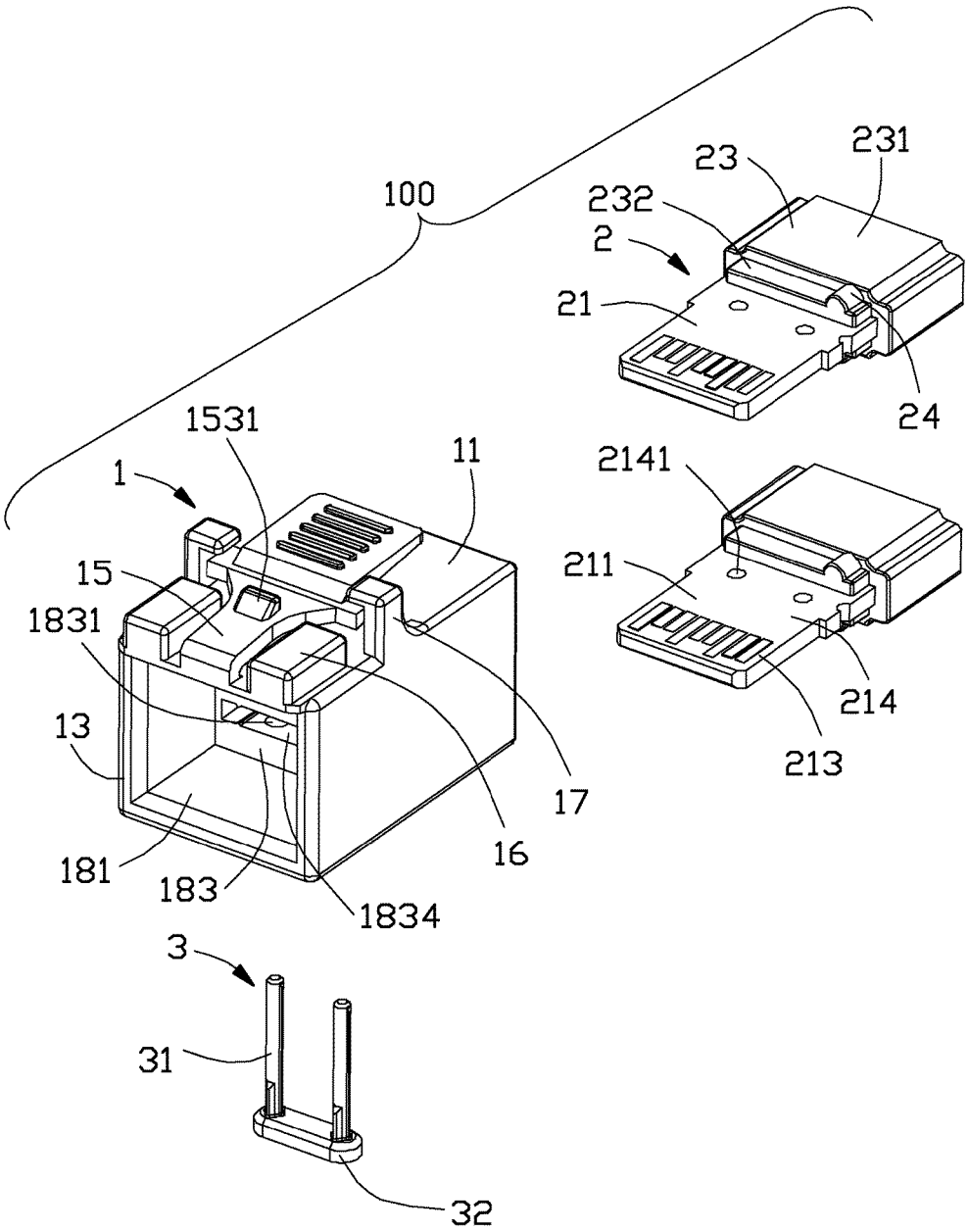
FIG. 3 is an exploded, perspective view of the cable connector assembly shown in FIG. 1.
Figure 4:
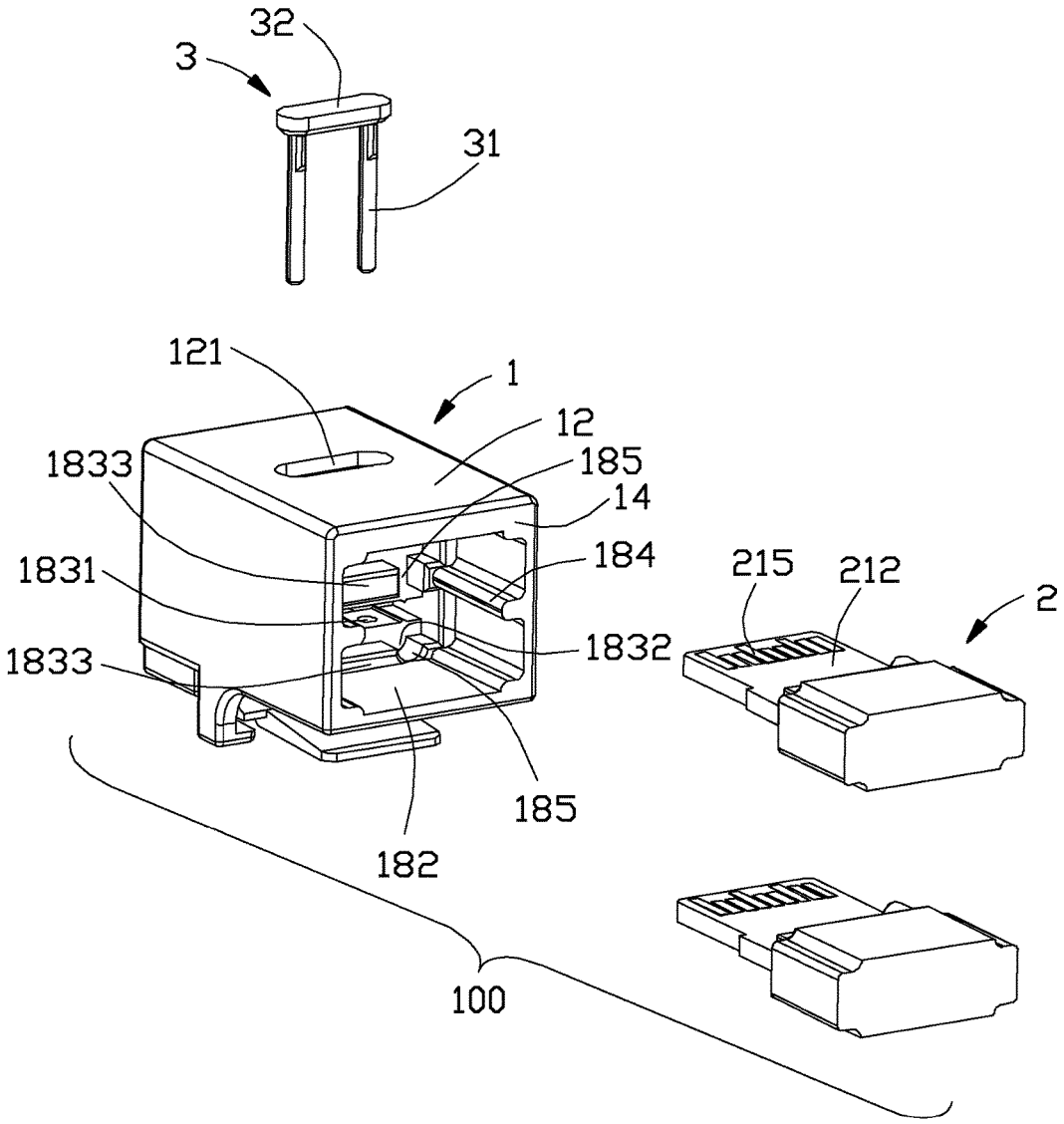
FIG. 4 is a view similar to FIG. 3, but viewed from another aspect.
Figure 5:
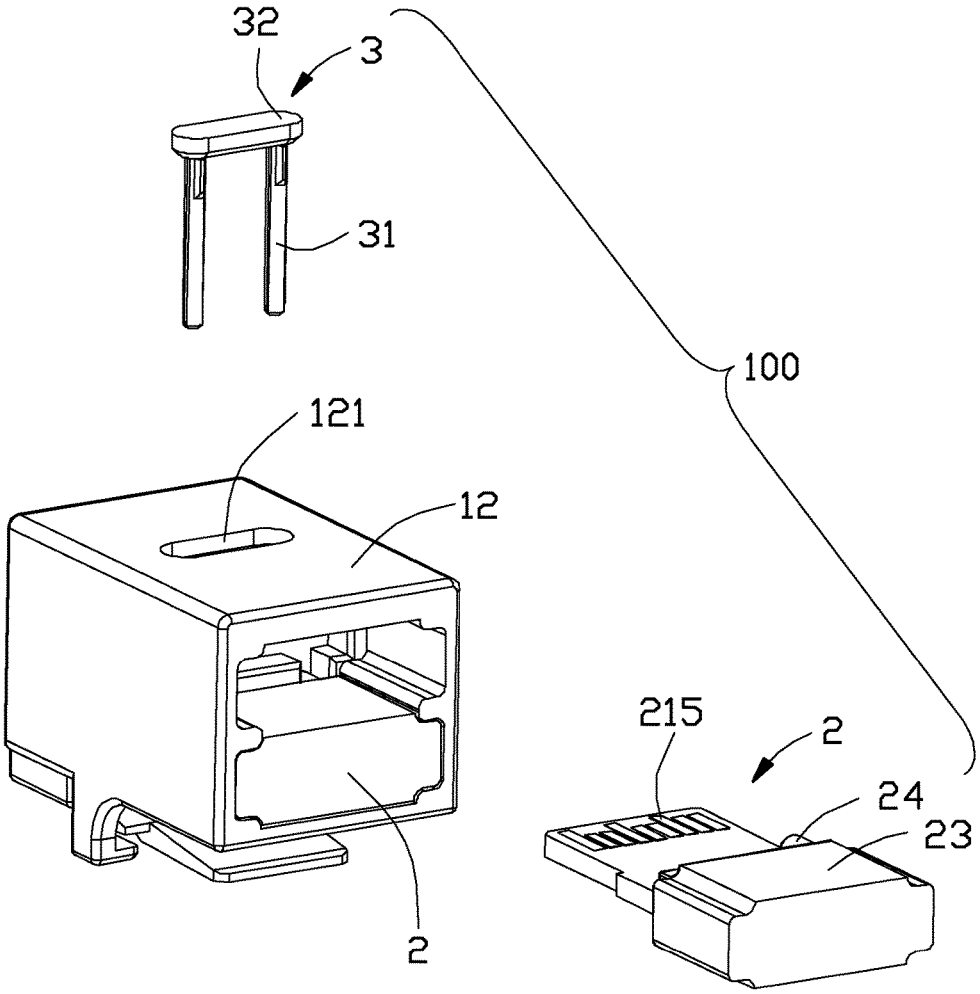
FIG. 5 is a partially assembled view of the cable connector assembly shown in FIG. 4.
Figure 6:
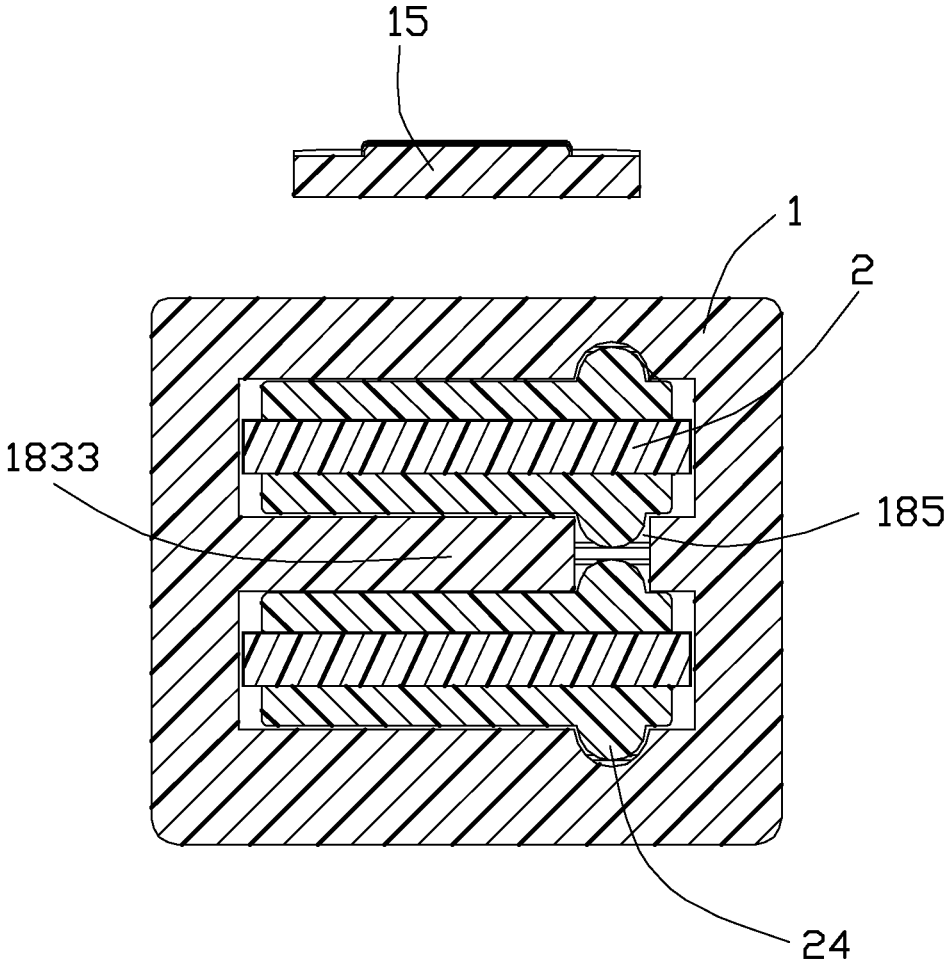
FIG. 6 is a cross section view of the cable connector assembly taken along line 6-6 shown in FIG. 1.
Figure 7:
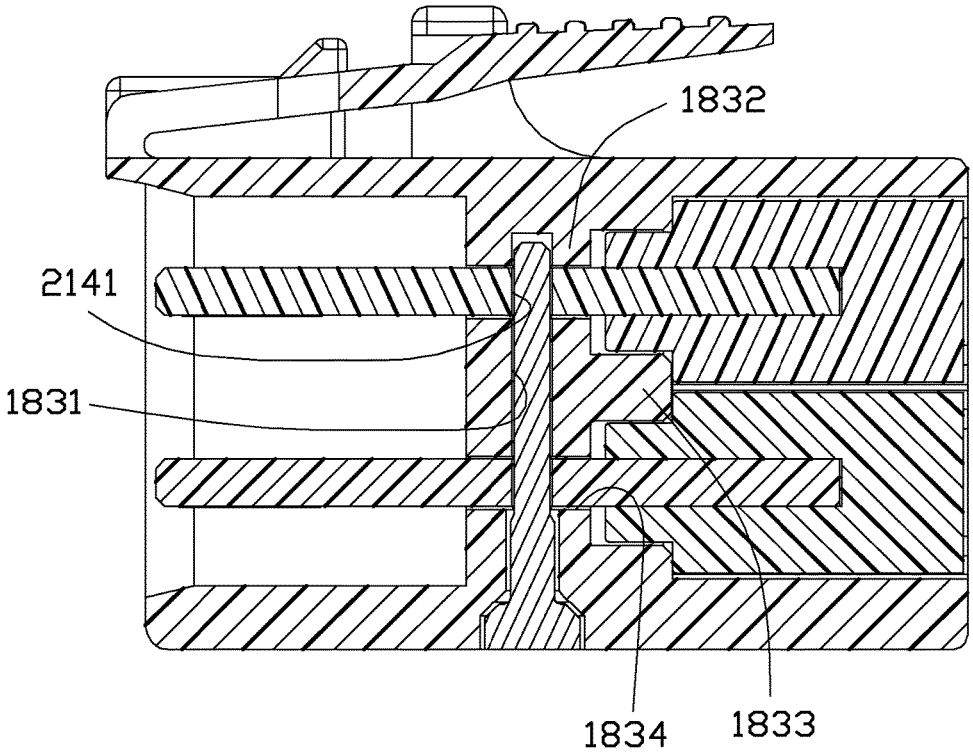
FIG. 7 is a cross section view of the cable connector assembly taken along line 7-7 shown in FIG. 1.

Reference will now be made to the drawing figures to describe the present invention in detail. Referring to FIGS. 1-7, a cable connector assembly 100 made in accordance with the present invention can be mated with a complementary connector, and comprises an insulative housing 1, a printed circuit board module 2 received in the insulative housing 1, and a positioning or securing member 3 assembled to the insulative housing 1 for holding the printed circuit board module 2 with the insulative housing 1 reliably. In the preferred embodiment, there are two printed circuit board modules 2, and the two printed circuit board modules 2 with a same configuration are stacked with each other. Each printed circuit board module 2 comprises a printed circuit board 21, a plurality of wires (not shown) electrically connected with the printed circuit board 21, and an insulator 23 molded on a connection between the printed circuit board 21 and the wires, the construction and connection being all well known in this art such as above-mentioned U.S. Pat. No. 8,834,185.

The insulative housing 1 has a top wall 11 and a bottom wall 12 opposite to each other, and a front end surface 13 and a back end surface 14 opposite to each other. The top wall 11 of the insulative housing 1 defines a latch mechanism 15, a pair of protrusions 16 on both sides of the latch mechanism 15, and a pair of stopping portions 17 behind corresponding protrusion 16. The insulative housing 1 has a receiving space 18 extending from the front end surface 13 to the back end surface 14 along a front-to-back direction. The receiving space 18 is divided into a front space 181 and a rear space 182 by a partition 183. The front space 181 is served as a mating port formed on the insulative housing 1, the rear space 182 has a pair of opposite barriers 184 on both inner side walls thereof, and the two barriers 184 are used for separating the rear space 182 into two fields along a vertical direction and making the two insulators 23 of the printed circuit board modules 2 match with inner walls of the rear space 182. The insulative housing 1 has a hollow 121 on the bottom wall 12. The partition 183 is located above the hollow 121 and defines a pair of receiving holes 1831. In this embodiment, referring to FIG. 7, the partition 183 includes a front vertical plate section 1832 and a rear shoulder section 1833. The front vertical plate section 1832 forms the transverse slots 1834 to receive the corresponding printed circuit boards 21 therein.

The latch mechanism 15 is unitarily formed on the top wall 11 of the insulative housing 1 and comprises a front connecting portion 151, a rear pressing portion 152, a locking portion 153 linking with the connecting portion 151 and the pressing portion 152, and a pair of wing portions 154 extending outwards from both sides of the pressing portion 152. The locking portion 153 has a locking tab 1531 on a top surface thereof. There is a certain distance between the pressing portion 152 and the top wall 11 of the insulative housing 1, and the latch mechanism 15 is cantilevered relative to the top wall 11 of the insulative housing 1. As the latch mechanism 15 is elastic, when an operator presses the pressing portion 152, the locking portion 153 will move down, and the locking portion 153 can restore to its original state when the operator release the pressing portion 152.

Therefore the cable connector assembly 100 can latch and disengage with a complementary connector (not shown) by pressing the pressing portion 152.

The pair of protrusions 16 are neighboring to a front end surface of the insulative housing 1 and symmetrically arranged on both sides of the locking portion 153 to prevent the cable connector assembly 100 from deflecting while mating with the complementary connector.

Each stopping portion 17 comprises a vertical portion 171 extending upwards from the top wall 11 of the insulative housing 1 and a horizontal limiting portion 172 extending inwards from a top end of the corresponding vertical portion 171. The stopping portions 17 can prevent the cable connector assembly 100 from transitionally inserting into the complementary connector and also can prevent the pressing portion 152 from moving upwards continuously when an extra force is applied on the latch mechanism 15. So the limiting portion 172 can prevent damage to the latch mechanism 15.

Each printed circuit board 21 has an upper surface 211 and a lower surface 212 opposite to each other. Different conductive traces are defined on the upper surface 211 and the lower surface 212 of each printed circuit board 21, and each printed circuit board module 2 defines a protruded ridge or protrusion 24 neighboring to one side thereof. A groove 185 is defined in the receiving space 18 of the insulative housing 1 for accommodating the protruded ridge 24, thus preventing the printed circuit board modules from mis-plugging. In fact, in this embodiment the groove 185 is formed in the rear shoulder section 1833. The protruded ridges 24 are extending along the front-to-back direction. The protruded ridge 24 can be defined on the upper surface 211 or the lower surface 212, or both of the upper surface 211 and the lower surface 212. In some embodiment, when the number of the protruded ridges 24 on the upper surface 211 is same as the number of the protruded ridges 24 on the lower surface 212, the protruded ridges 24 on each printed circuit board 21 are located on both sides of a longitudinal central axis and stagger with each other, and at least one pair of protruded ridges 24 on both sides of the longitudinal central axis are defined with different distance away from the longitudinal central axis, thus also can achieve an effect of preventing mis-plugging. In other embodiment, the number of the protruded ridges 24 on the upper surface 211 can be arranged different from the number of the protruded ridges 24 on the lower surface 212 to achieve the same effect.

Each printed circuit board 21 defines a front mating segment 213 and an intermediate segment 214 behind the mating segment 213. A plurality of conductive pads 215 are defined on the upper surface 211 and the lower surface 212 of the mating segment 213, respectively, for mating with the complementary connector. The intermediate segment 214 defines a pair of fixing holes 2141 along a transverse direction.

Each insulator 23 comprises a rear section or main section 231 molded on a conjunction area between the printed circuit board 21 and the wires and a front section or step section 232 extending forwards from the rear section 231, and the protruded ridge 24 is extending upwards from a top surface of the front section 232. In this embodiment, the front section 232 essentially abuts against the shoulder section 1833 in the vertical direction and the corresponding protruded ridge 24 is received within the groove 185 which is formed in the shoulder section 1833.

The positioning member 3 is made of insulative material, and comprises a pair of pins 31 and a main portion 32 connecting with the two pins 31.

In assembly, the two printed circuit board modules 2 are assembled into the receiving space 18 of the insulative housing 1 along a back-to-front direction, and stacked with each other along a vertical direction. The fixing holes 2141 of the printed circuit board 21 are aligned with the corresponding receiving holes 1831 of the partition 183 along the vertical direction.

Then the positioning member 3 is assembled to the insulative housing 1 along a down-to-up direction, and the two pins 31 are inserted into the receiving holes 1831 of the partition 183 and the fixing holes 2141 of the two printed circuit boards 21 in order along the vertical direction. The two pins 31 are interference fit with the two printed circuit boards 21. The main portion 32 of the positioning member 3 is fixed in the hollow 121 of the insulative housing 1, thus the stacked printed circuit board modules 2 are fastened in the insulative housing 1 by the positioning member 3.

With the cable connector assembly 100 assembled, when operator exerts a downward force on the pressing portion 152 of the latch mechanism 15, the locking portion 153 will move downwards, and the cable connector assembly 100 can be mated with the complementary connector. After removing the downward force, the latch mechanism 15 can be restored to its original state and locked with the complementary connector. Due to the asymmetric protruded ridges 24 and the grooves 185 associated with the corresponding protruded ridges 24, the printed circuit board modules 2 can be assembled into the insulative housing 1 without error.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative housing defining a partition to form therein a front receiving space and a rear receiving space separated by said partition in a front-to-back direction;

vertically aligned two grooves are formed in a rear shoulder section of the partition;

a printed circuit board (PCB) module extending through the partition and including a PCB disposed in the front receiving space, and an insulator secured on the PCB; and the insulator includes a rear main section and two front step sections formed on two opposite surfaces of the PCB module in a vertical direction perpendicular to said front-to-back direction;

a protrusion formed on each of the front step section of the insulator; wherein said protrusions are received within the respective grooves when the PCB module is correctly inserted through the partition forwardly along the front-to-back direction; while no groove is formed in the rear shoulder section of the partition to receive the protrusion when the PCB module is incorrectly inserted into the forwardly along the front-to-back direction in a widthwise flip upside down manner so as to prevent misorientation of the PCB module during assembling.

* * * * *